US008750552B2

(12) United States Patent
Barinaga et al.

(10) Patent No.: US 8,750,552 B2
(45) Date of Patent: Jun. 10, 2014

(54) MULTI-DIAMETER SPEAKER VENT PORTS

(75) Inventors: Louis Barinaga, Snohomish, WA (US); Carlos Manzanedo, Kirkland, WA (US)

(73) Assignee: Microsoft Corporation, Redmond, WA (US)

( * ) Notice: Subject to any disclaimer, the term of this patent is extended or adjusted under 35 U.S.C. 154(b) by 77 days.

(21) Appl. No.: 13/343,306

(22) Filed: Jan. 4, 2012

(65) Prior Publication Data

US 2013/0170691 A1 Jul. 4, 2013

(51) Int. Cl.
*H04R 25/00* (2006.01)
*H04R 21/02* (2006.01)

(52) U.S. Cl.
USPC ..... 381/370; 381/357

(58) Field of Classification Search
CPC ..... H04R 1/1016; H04R 1/10
USPC ..... 381/23.1, 312, 328, 380, 370, 371, 373, 381/374, 381; 181/135
See application file for complete search history.

(56) References Cited

U.S. PATENT DOCUMENTS 4,742,887 A * 5/1988 Yamagishi ..... 181/129
6,738,487 B1 5/2004 Nageno et al.
8,027,481 B2 9/2011 Beard
8,194,910 B2 * 6/2012 Uchida et al. ..... 381/370
2006/0078154 A1 4/2006 Yang
2009/0232340 A1 9/2009 Yang
2010/0061580 A1 3/2010 Tiscareno et al.
2012/0002838 A1 * 1/2012 Goller ..... 381/431
2012/0207339 A1 * 8/2012 Babb ..... 381/400

OTHER PUBLICATIONS

"Dunu Dn-16 VS IE7 (How DN-16 developed)—Part 1", Retrieved at <<http://www.head-fi.org/t/558337/dunu-dn-16-vs-ie7-how-do-16-developed-part-1>>, Retrieved Date: Dec. 9, 2011, pp. 8.
Sägmüller, Martin., "Ecci PR401 Review", Retrieved at <<http://anythingbutipod.com/2011/04/ecci-pr401-review/>>, Apr. 21, 2011, pp. 5.
"Beyerdynamic T1 Tesla—Product Description", Retrieved at <<http://www.iheadphones.co.uk/beyerdynamic-t1-tesla.html>>, Retrieved Date: Dec. 12, 2011, pp. 3.

* cited by examiner

*Primary Examiner* — Brian Ensey
*Assistant Examiner* — Norman Yu
(74) *Attorney, Agent, or Firm* — Judy Yee; Micky Minhas

(57) ABSTRACT

Embodiments are disclosed that relate to controlling frequency response in speaker assemblies. For example, one disclosed embodiment provides a speaker assembly including a speaker, a body supporting the speaker in such a manner as to define a back chamber between the speaker and the body, and a vent port formed in the body and extending through the body, the vent port comprising a first stage having a first diameter, a second stage having a second diameter different than the first diameter, and a step between the first stage and the second stage.

20 Claims, 4 Drawing Sheets

MULTI-DIAMETER SPEAKER VENT PORTS

BACKGROUND

Speaker assemblies are used in a wide variety of applications to produce sound from one or more electrical signals. A speaker assembly may include a speaker mounted within a body, and a space, or back chamber, defined by the body behind a back side of the speaker. The configuration of a back chamber may have a significant impact on the acoustic properties of a speaker. For example, a poorly designed back chamber may attenuate some frequencies more than others, thereby leading to poor sound reproduction. As such, a speaker assembly may comprise various structures, such as vent ports connecting the back chamber to the outside of the assembly, to help tune the frequency response of the speaker assembly.

SUMMARY

Embodiments are disclosed that relate to speaker assemblies having back chamber vent ports with multiple stages of different diameters. For example, one disclosed embodiment provides a speaker assembly including a speaker, a body supporting the speaker in such a manner as to define a back chamber between the speaker and the body, and a vent port formed in the body and extending through the body, the vent port comprising a first stage having a first diameter, a second stage having a second diameter that is different than the first diameter, and a step between the first stage and the second stage.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

As mentioned above the design of the back chamber between a speaker and a speaker assembly body may significantly affect the audio performance of the speaker assembly. For example, the use of too small of a back chamber may lead to uneven frequency response.

Particular difficulties may be encountered when designing speaker assemblies intended to rest in a user's outer ear canal, such as ear bud-style speakers, as audio fidelity and miniaturization are competing concerns for such devices. For example, the potential size of such speaker assemblies is limited by the size of the outer portion of a user's ear canal, as too large of a speaker assembly may not rest comfortably within a user's ear. However, some methods for tuning speaker back chambers may constrain the ability to miniaturize the back chamber of such a speaker. As a result, a speaker assembly may utilize a smaller speaker than desired in order to rest correctly in the outer ear canal of a user, thereby sacrificing a desired level of audio fidelity.

Some speaker assemblies have addressed such issues via the use of cylindrical acoustic vent ports extending through the speaker assembly body between the back chamber and the outside of the body. Such vent ports may allow a smaller back chamber to be utilized. However, depending upon the design of a particular speaker assembly, cylindrical vent ports configured to provide a desired frequency response may be of such small diameter as to be difficult and expensive to manufacture.

Accordingly, various embodiments are disclosed herein that relate to speaker assemblies having multi-diameter vent ports extending through the body from the speaker back chamber to the outside of the body. Such multi-diameter vent ports may allow a desired frequency response to be achieved via a smaller back volume and/or larger average diameter vent ports than a comparable speaker assembly of comparable audio quality with single-diameter cylindrical vent ports. This may help to simplify the manufacturing, of high fidelity, miniaturized speaker assemblies.

Figure 1:
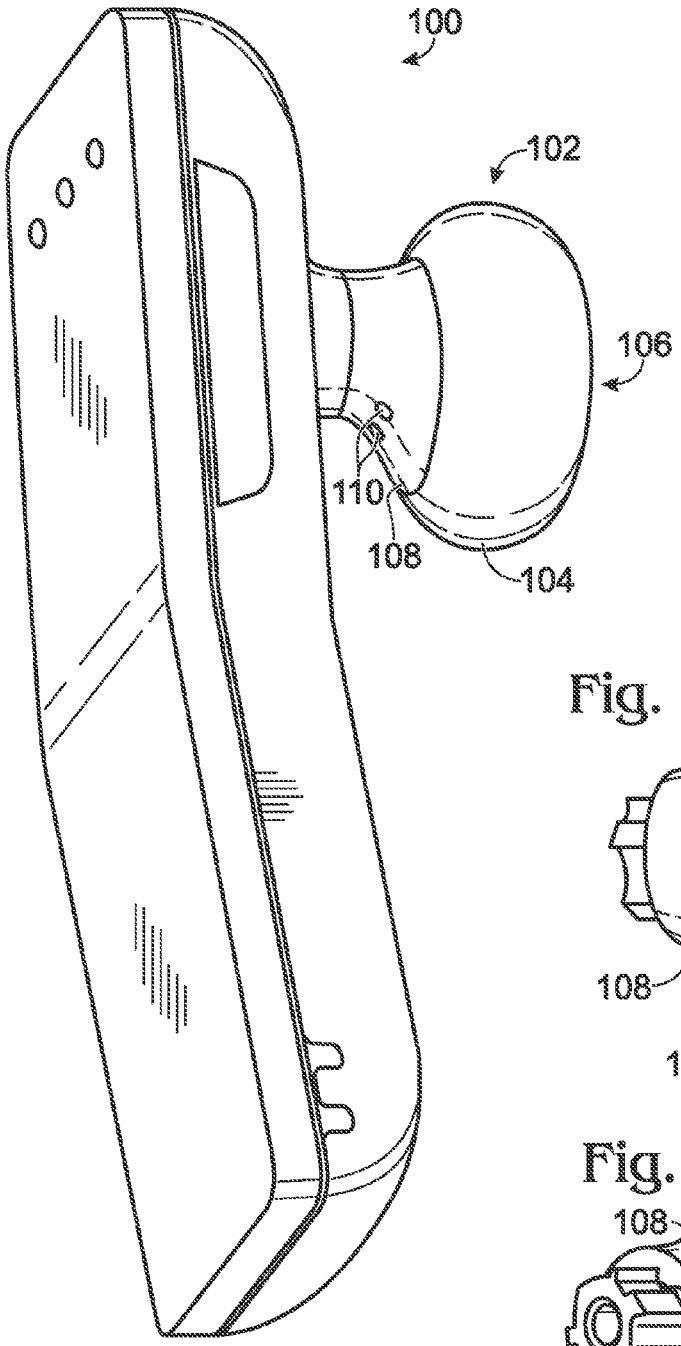
FIG. 1 shows an embodiment of a headset comprising a speaker assembly.
Figure 2:
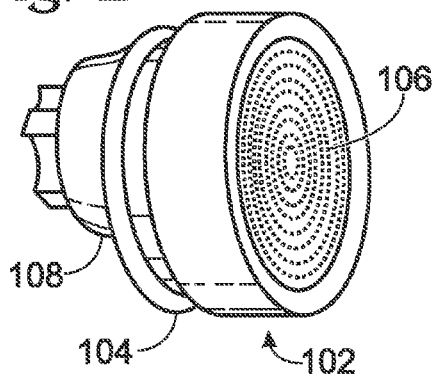
FIG. 2, shows a perspective view of a front surface of the speaker assembly of FIG. 1.
Figure 3:
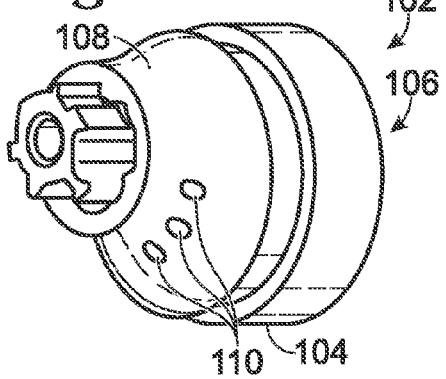
FIG. 3 shows a perspective view of a rear surface of the speaker assembly of FIG. 1.

FIG. 1 shows an embodiment of an audio device in the form of a headset 100 comprising a speaker assembly 102, and FIGS. 2-3 show perspective views of the speaker assembly 102. The depicted speaker assembly 102 takes the form of an ear bud speaker, but it will be understood that a speaker assembly according to the present disclosure may have any other suitable configuration. In FIG. 1, an ear gel is depicted as covering the front side of the speaker assembly. In FIGS. 2-3, the ear gel is omitted for clarity. Speaker assembly 102 comprises a body 104 having a front side 106 through which sound from a speaker is directed, and a back side 108 comprising a plurality of vent ports 110. While the depicted embodiment comprises three vent ports 110 arranged in an arc around a portion of the back side 108 of the body 104, it will be understood that any suitable number and arrangement of vent ports may be used. Further, it will be understood that headset 100 is presented for the purpose of example and is not intended to be limiting in any manner, as any suitable audio device may utilize a speaker assembly according to the present disclosure.

Figure 4:
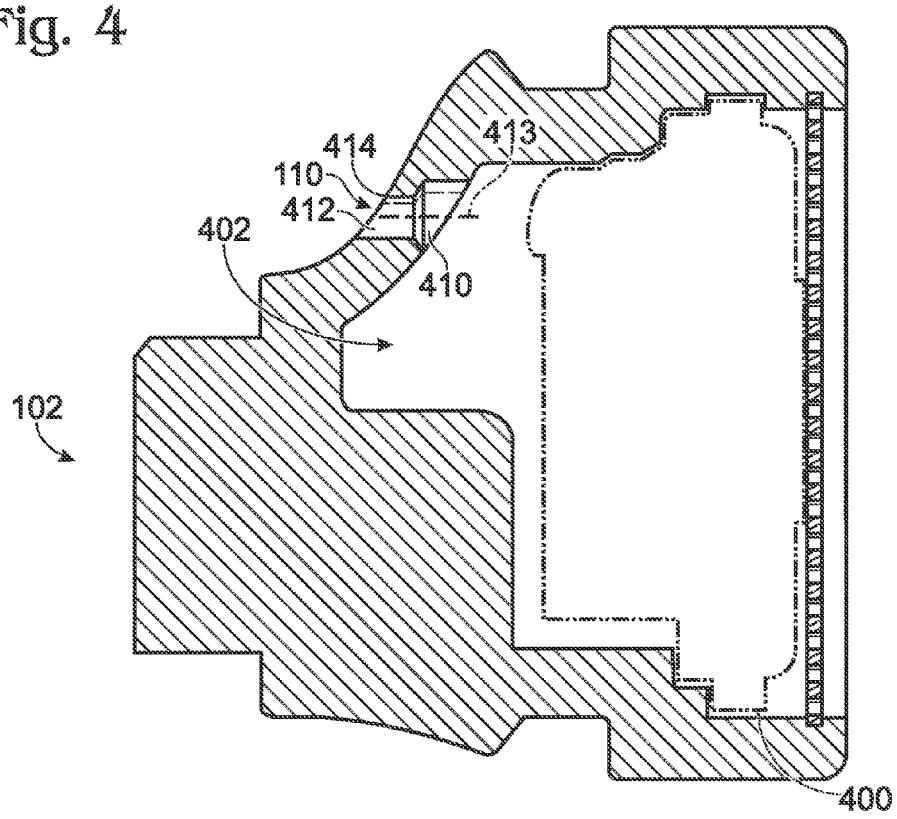
FIG. 4 shows a sectional view of the speaker assembly of FIG. 1.

FIG. 4 shows a sectional view of the speaker assembly 102, and illustrates a speaker 400 and a back chamber 402 arranged within the body 104. Further, one of the vent ports 110 is also shown in sectional view. As illustrated, the vent port 110 comprises a first stage 410 having a first diameter, and a second stage 412 having a second, smaller diameter. The first stage 410 and second stage 412 are separated by a step 414. In the depicted embodiment, the first stage 410 and the second stage 412 are each depicted as having a cylindrical configuration along an axis 413 that extends through the first stage 410 and the second stage 412. In other embodiments, the first stage and/or the second stage may have a sloped (e.g.

conical) cross sectional shape that varies along axis 413, or may have any other suitable shape.

Likewise, the step 414 may have any suitable configuration. For example, in the depicted embodiment, the step 414 slopes inwardly between the first stage 410 and the second stage 412 along axis 413. In other embodiments, the step 414 may transition sharply between the first stage 410 and the second stage 412, such that the step comprises a surface having a plane orthogonal to an axis extending through the first stage and the second stage. In yet other embodiments, the step 414 may have any other suitable configuration. The term "step" as defined herein may include any structure that defines a sharper rate of diameter change than the stages on either side of the step in an axial direction through the vent port. While the depicted embodiment comprises two stages separated by a step, it will be understood that other embodiments may have three or more stages separated by respective steps. It further will be understood that a number of stages/steps, a configuration of each stage and/or step, a diameter ratio of the stages, a steepness of each step, a number of vent ports, and/or any other suitable variable of a speaker assembly design may be tailored during a design process to tune and optimize a frequency response of a particular speaker assembly.

Each vent port 110 may have any suitable orientation with respect to the back chamber 402 and the inner and outer surfaces of the body 104. For example, in the embodiment of FIG. 4, the vent ports are arranged such that inner and outer surfaces of the body through which the vent port 110 extends are sloped relative to an axis extending through the first stage 410 and the second stage 412. In other embodiments, the vent port 110 may be arranged such that one or more of these surfaces are orthogonal to an axis extending through the first stage 410 and the second stage 412.

The first stage 410 and the second stage 412 may have any suitable diameters and diameter ratio. As mentioned above, the use of a multi-diameter vent port 110 may allow a selected frequency response to be achieved via larger vent port diameters than a single diameter vent port. For example, an ear bud speaker assembly for which a 0.3 mm single-diameter vent port would give a desired frequency response may instead utilize a multi-diameter vent port having a first stage and a second stage with diameters of 1.0-1.5 mm and 0.5-0.8 mm respectively. Without wishing to be bound by theory, the inlet of each stage leads to a viscous loss due to the air flowing through the inlet. Thus, a single-diameter vent port will have a single viscous loss, whereas the multi-diameter vent port will have a different viscous loss at the inlet of each stage. As each loss in the multi-diameter port hole has a different acoustic damping capability, the relative size ratio or ratios of the stages, in addition to the actual diameters of each individual stage, may affect the damping of the vent port as a whole. This may permit back chamber tuning to be performed by varying the size ratio of the stages without having to resort to undesirably small port hole diameters.

Figure 5:
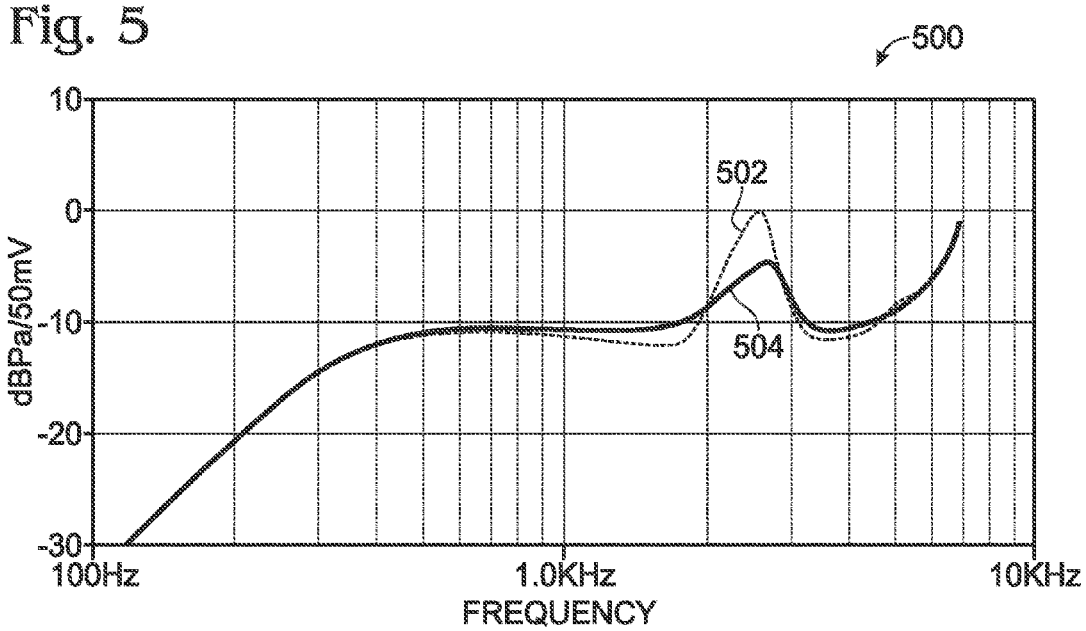
FIG. 5 shows a plot illustrating frequency response curves of speaker assemblies having single-diameter vent ports.

FIGS. 5-8 show graphs that illustrate frequency response curves for various vent port configurations as determined from fluid dynamic modeling. First, FIG. 5 shows a graph 500 illustrating frequency response plots for a speaker assembly having one 1 mm diameter cylindrical vent port (at line 502), and a speaker assembly having five 0.5 mm diameter cylindrical vent ports (at line 504). As can be seen, the 1×1.0 mm vent port line 502 shows a frequency response spike between 2 kHz and 3 kHz. Such a spike may lead to an undesirably high output at high audible frequencies compared to other frequencies. The 5×0.5 mm vent port line 504 shows a more even frequency response than curve line. However, an ear bud-style speaker assembly with five 0.5 mm vent ports may be very difficult to manufacture.

Figure 6:
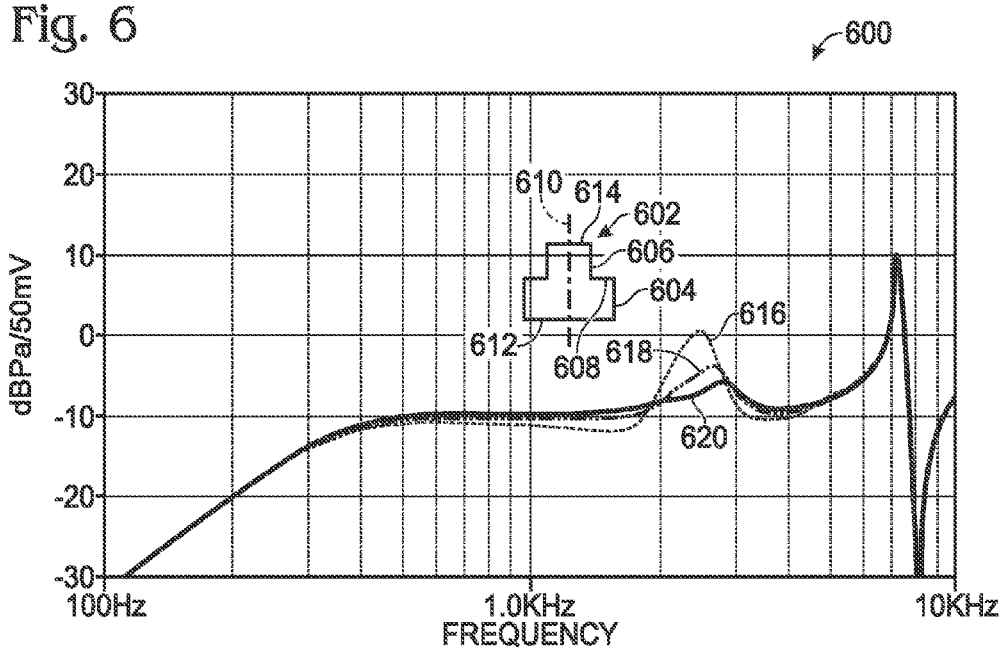
FIG. 6 shows a plot illustrating frequency response curves of speaker assemblies having multi-diameter vent ports of a first example configuration.

Next, FIG. 6 shows a graph 600 illustrating frequency response plots for a speaker assembly having multi-diameter vent ports of a configuration shown at 602. The depicted configuration 602 comprises a first stage 604 having a diameter of 1.0 mm, a second stage 606 having a diameter of 0.5 mm, and a step 608 between the first stage 604 and the second stage 606, wherein a surface of the step is orthogonal to an axis 610 that extends through the first stage 604 and the second stage 606. Further, the axis 610 is also orthogonal to an inner port opening plane 612 and an outer port opening plane 614. Three frequency response plots are illustrated a two-port line 616 corresponding to two vent ports of configuration 602, a three-port line 618 corresponding to three vent ports of configuration 602, and a four-port line 620 corresponding to four vent ports of configuration 602. As can be seen, the frequency response plots flatten progressively as more vent ports of configuration 602 are added. It can further be seen that the frequency response of the four-port configuration (line 620) is flatter and more consistent than that of the 5×0.5 mm configuration of FIG. 5 within a frequency range of interest (e.g. up to about 3.5 kHz).

Figure 7:
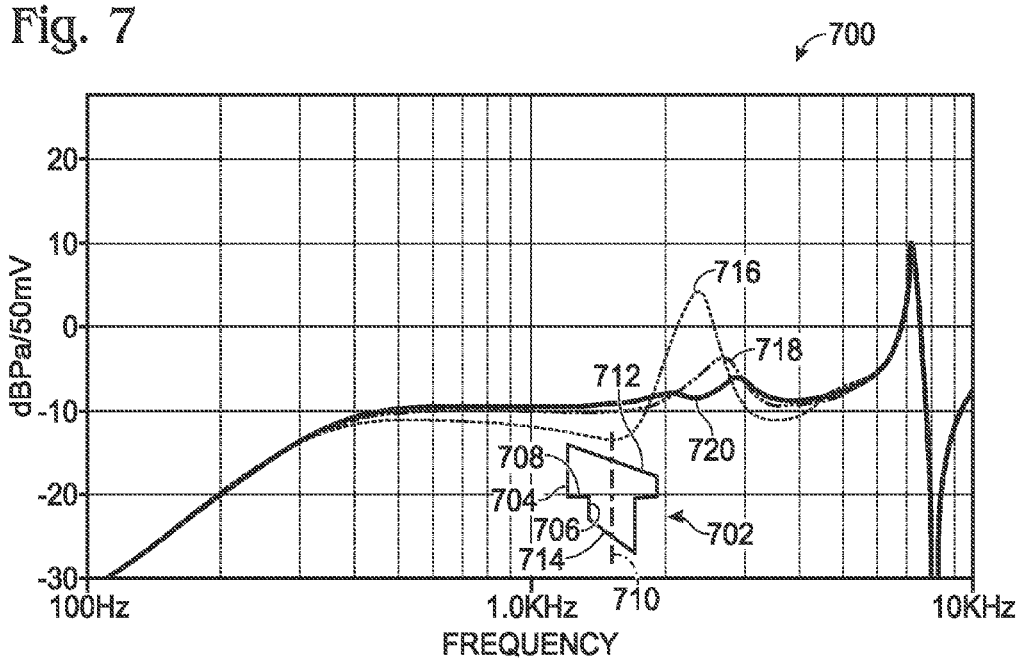
FIG. 7 shows a plot illustrating frequency response curves of speaker assemblies having multi-diameter vent ports of a second example configuration.

FIG. 7 shows a graph 700 illustrating frequency response plots for a speaker assembly having multi-diameter vent ports of a configuration shown at 702. The depicted configuration 702 comprises a first stage 704 having a diameter of 1.0 a second stage 706 having a diameter of 0.7 mm, and a step 708 between the first stage 704 and the second stage 706, wherein a surface of the step is orthogonal to an axis 710 that extends through the first stage 704 and the second stage 706. Further, an inner port opening plane 712 and an outer port opening plane 714 of the vent port are each arranged at a slope relative to axis 710. Three frequency response plots are illustrated—a one-port line 716 corresponding to one vent port of configuration 702, a two-port line 718 corresponding to two vent ports of configuration 702, and a three-port line 720 corresponding to three vent ports of configuration 702. As can be seen, the frequency response plots flatten progressively as more vent ports of configuration 702 are added. It can further be seen that the frequency response of the three-port line 720 is flatter and more consistent than that of the 5×0.5 mm configuration of FIG. 5, as well as that of the four-port line 620 of FIG. 6. Thus, it can be seen that vent port configuration 702 may allow a speaker assembly with fewer vent ports and a wider minimum diameter compared to a speaker assembly that utilizes single diameter vent ports. It further can be seen that the sloped port openings of configuration 702 may offer greater benefits than to dual-diameter vent port configuration without such sloped openings, such as configuration 602.

Figure 8:
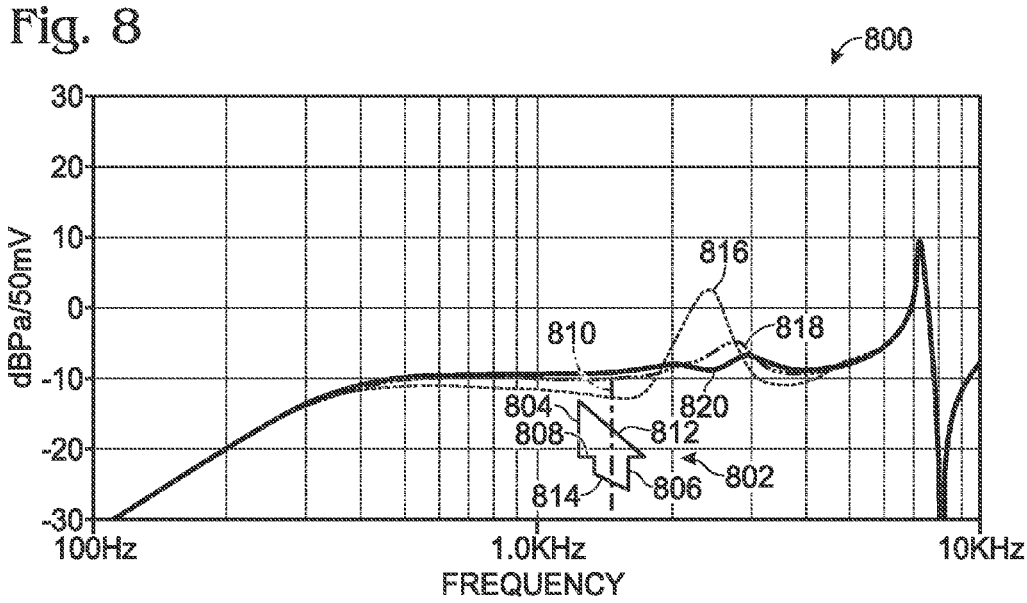
FIG. 8 shows a plot illustrating frequency response curves of speaker assemblies having multi-diameter vent ports of a third example configuration.

FIG. 8 shows a graph 800 illustrating frequency response plots for a speaker assembly having multi-diameter vent ports of another example configuration shown at 802. The depicted configuration 802 comprises a first stage 804 having a diameter of 1.4 mm, a second stage 806 having a diameter of 0.7 mm, and a step 808 between the first stage 804 and the second stage 806, wherein a surface of the step is orthogonal to an axis 810 that extends through the first stage 804 and the second stage 806. Thus, the diameter ratio of the first stage and second stage is the same as that of configuration 602 of FIG. 6. Further, an inner port opening plane 812 and an outer port opening plane 814 of the vent port are each arranged at a slope relative to axis 810, wherein the slopes are steeper than those of configuration 702 of FIG. 7. Three frequency response plots are illustrated—a one-port line 816 corresponding to one vent port of configuration 802, a two-port line 818 corresponding to two vent ports of configuration 802, and a three-port line 820 corresponding to three vent ports of configuration 802. As can be seen, the frequency response curves again flatten progressively as more vent ports of configuration 802 are added. It can further be seen that the frequency response of the three-port curve may have the flattest profile of those shown in FIGS. 5-8. It is further noted that configuration 802 has the largest average diameter of the configurations of FIGS. 5-8. Configuration 802 also may offer the benefit that the more steeply sloped inner and outer surface openings may allow the use of a smaller back volume than the configurations of FIGS. 6 and 7.

Thus, the disclosed embodiments may allow the construction of a speaker assembly with a smaller number of larger diameter vent ports than a similar speaker assembly having single-volume vent ports. Further, the use of vent ports having slanted inner and outer surface openings likewise may allow the use of a fewer number of wider vent ports compared to other configurations.

Figure 9:
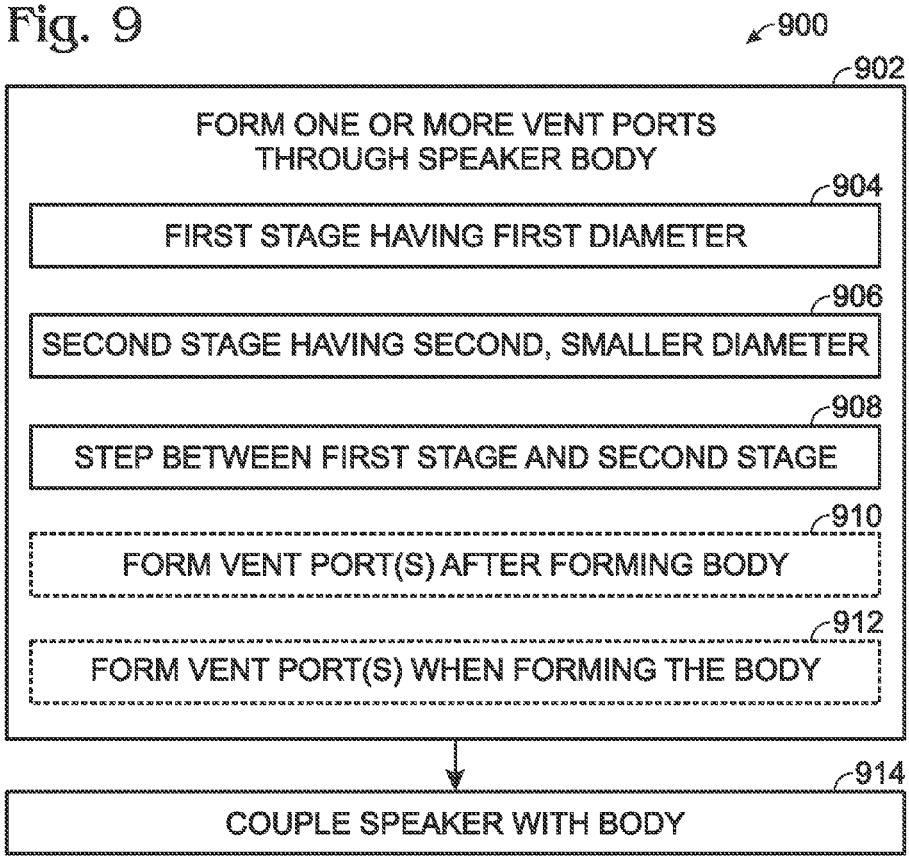
FIG. 9 shows a flow diagram depicting an embodiment of a method of making a speaker assembly.

A speaker assembly according to the present disclosure may be made in any suitable manner. For example, FIG. 9 shows an embodiment of a method 900 of making a speaker assembly comprising a body and a speaker supported by the body. Method 900 comprises, at 902, forming one or more vent ports through the speaker body, wherein each vent port comprises a first stage 904 having a first diameter, a second stage 906 located farther from the speaker than the first stage and having a second diameter smaller than the first diameter, and a step 908 between the first stage and the second stage. Each of the first stage and second stage may be cylindrical in configuration, sloped in configuration along an axial direction, or may have any other suitable shape.

The diameters and diameter ratios of the first and second stages may have any suitable values, including but not limited to those described above. Likewise, any suitable number of vent ports may be formed through the body, including but not limited to those described above. Additionally, the vent ports may have openings that are arranged normal to an axis through the vent port, or that are arranged at an angle relative to an axis through the vent port. It will be understood that the relative angles of such openings may depend upon the shape of the body at the location of the vent port. Further, in some embodiments, the first and second stages may not be co-axial. Instead, in such embodiments, axes extending through the first and second stages may meet at an angle.

Likewise, the step between the stages may have any suitable configuration. For example, in some embodiments, the step may be conical or otherwise progressively narrowing along an axis that runs through the two stages, while in other embodiments, the step may be orthogonal to such axis, or may have any other suitable configuration.

In some embodiments, the one or more vent ports may be formed after forming the body, as indicated at 910. In such an embodiment, each vent port may be formed via a single step (e.g. via a countersinking drill bit), or each stage may be formed via a separate stage (e.g. by different diameter drill bits). In other embodiments, the one or more vent ports may be formed when forming the body, as indicated at 912. For example, in such an embodiment, each vent port may be formed via a structure within a mold used to form the speaker assembly body. In either case, after forming the vent ports through the body, method 900 comprises, at 914, coupling a speaker with the body. It will be understood that these manufacturing methods are presented for the purpose of example, and are not intended to be limiting in any manner.

it is to be further understood that the configurations and/or approaches described herein are presented for example, and that these specific embodiments or examples are not to be considered in a limiting sense, because numerous variations are possible. The specific routines or methods described herein may represent one or more of any number of processing strategies. As such, various acts illustrated may be performed in the sequence illustrated, in other sequences, in parallel, or in some cases omitted. Likewise, the order of the above-described processes may be changed.

The subject matter of the present disclosure includes all novel and nonobvious combinations and subcombinations of the various processes, systems and configurations, and other features, functions, acts, and/or properties disclosed herein, as well as any and all equivalents thereof.

The invention claimed is:

1. A speaker assembly, comprising:

a speaker;

a body supporting the speaker in such a manner as to define a back chamber positioned behind the speaker and between the speaker and the body; and a vent port formed in the body, the vent port extending through the body from the back chamber to an exterior of the speaker assembly, the vent port comprising a first stage having a first diameter, a second stage having a second diameter different than the first diameter, and a step between the first stage and the second stage, wherein the step defines a sharper rate of diameter change than both the first stage and the second stage.

2. The speaker assembly of claim 1, wherein the step comprises a surface having a plane orthogonal to an axis extending through one or more of the first stage and the second stage.

3. The speaker assembly of claim 1, wherein the step comprises a sloped cross-sectional shape along a direction of an axis extending through one or more of the first stage and the second stage.

4. The speaker assembly of claim 1, further comprising a plurality of vent ports.

5. The speaker assembly of claim 1, wherein one or more of the first stage and the second stage has a cylindrical cross-sectional shape along an axis extending through the first stage and the second stage.

6. The speaker assembly of claim 1, wherein one or more of the first stage and the second stage has a sloped cross-sectional shape along an axis extending through the first stage and the second stage.

7. The speaker assembly of claim 1, wherein the vent port is arranged such that an axis extending through the first stage and the second stage is orthogonal to a surface of the body through which the vent port extends.

8. The speaker assembly of claim 1, wherein the vent port is arranged such that a surface of the body through which the vent port extends is sloped relative to an axis extending through one or more of the first stage and the second stage.

9. The speaker assembly of claim 1, wherein the first stage has a diameter of 1.0-1.5 mm, and wherein the second stage has a diameter of 0.5-0.8 mm.

10. A speaker assembly, comprising:

a speaker;

a body supporting the speaker in such a manner as to define a back chamber positioned behind the speaker and between the speaker and the body; and a plurality of vent ports formed in the body, the plurality of vent ports extending through the body from the back chamber to an exterior of the speaker assembly, each vent port of the plurality of vent ports comprising a first stage having a first diameter, a second stage located farther from the speaker than the first stage and having a second diameter smaller than the first diameter, and a step between the first stage and the second stage, wherein the step defines a sharper rate of diameter change than both the first stage and the second stage.

11. The speaker assembly of claim 10, wherein the step comprises a surface having a plane orthogonal to an axis extending through the first stage and the second stage.

12. The speaker assembly of claim 10, wherein the step comprises a sloped cross-sectional shape.

13. The speaker assembly of claim 10, wherein one or more of the first stage and the second stage has a cylindrical cross-sectional shape along an axis extending through the first stage and the second stage.

14. The speaker assembly of claim 10, wherein one or more of the first stage and the second stage has a sloped cross-sectional shape along an axis extending through the first stage and the second stage.

15. The speaker assembly of claim 10, wherein the vent port is arranged such that an axis extending through the first stage and the second stage is sloped relative to a surface of the body through which the vent port extends.

16. The speaker assembly of claim 10, wherein the speaker assembly is incorporated into a headset.

17. The speaker assembly of claim 10, wherein the speaker assembly is configured to rest within an outer ear canal of a user.

18. A method of manufacturing a speaker assembly, the speaker assembly comprising a body and a speaker, the body supporting the speaker in such a manner as to define a back chamber positioned behind the speaker and between the speaker and the body, the method comprising:

forming one or more vent ports that extend through the body from the back chamber to an exterior of the speaker assembly, wherein each vent port of the one or more vent ports comprises a first stage having a first diameter, a second stage located farther from the speaker than the first stage and having a second diameter smaller than the first diameter, and a step between the first stage and the second stage, wherein the step defines a sharper rate of diameter change than both the first stage and the second stage.

19. The method of claim 18, wherein forming the one or more vent ports through the body comprises forming the one or more vent ports after forming the body.

20. The method of claim 18, further comprising coupling a speaker with the body.

* * * * *